US005185600A

United States Patent [19]

Salam

[11] Patent Number: 5,185,600

[45] Date of Patent: Feb. 9, 1993

[54] DISPLAY DEVICES

[75] Inventor: Hassan P. A. Salam, Barnes, England

[73] Assignee: Unisplay SA, Fribourg, Switzerland

[21] Appl. No.: 541,543

[22] Filed: Jun. 21, 1990

[30] Foreign Application Priority Data

Jun. 23, 1989 [GB] United Kingdom ..... 8914521

[51] Int. Cl.[5] ..... G09G 3/16

[52] U.S. Cl. ..... 340/764; 340/783; 340/815.26; 40/449

[58] Field of Search ..... 340/815.26, 815.27, 340/815.05, 763, 764, 783; 40/447, 449; 116/204

[56] References Cited

U.S. PATENT DOCUMENTS 3,745,563 7/1973 Jones et al. ..... 40/447
3,975,728 8/1976 Winrow ..... 340/815.27
4,091,382 5/1978 Anderson et al. ..... 340/815.27
4,163,332 8/1979 Salam ..... 40/449
4,223,464 9/1980 Winrow ..... 40/449

*Primary Examiner*—Alvin E. Oberley
*Assistant Examiner*—Xiao M. Wu
*Attorney, Agent, or Firm*—Watson, Cole, Grindle & Watson

[57] ABSTRACT

A rotatable display element has a reflective indicating vane comprising a thin sheet which is mounted so as to be in a substantially planar state. Such a thin and light sheet typically has little or no structural rigidity and preferably, according to this invention, the means for mounting the sheet are arranged to provide a tensioning force in the sheet. This causes the sheet to be held in a substantially planar state. The sheet according to this invention is also preferably arranged to be easily removed and replaced when it becomes faded or soiled.

16 Claims, 3 Drawing Sheets

DISPLAY DEVICES

BACKGROUND AND SUMMARY OF THE INVENTION

This invention relates to display elements of the type in which the display element comprises a rotatable assembly including a reflective face and a permanent magnet acted upon by an electromagnet to drive the assembly between a first position in which the reflective face is exposed to the viewer and a second position in which it is hidden. Display devices of this type are described in U.S. Pat. Nos. 4,163,332; 3,975,728; 4,425,864; 4,015,255; and others.

With such display elements the energy needed to switch the element between its two visual states is dependent on the moment of inertia of the rotatable assembly. The rate of wear of the bearings of the rotatable assembly is also dependent on the moment of inertia. An object of the present invention is to reduce the moment of inertia and hence to reduce both the switching energy required and the rate of bearing wear, and thus to extend the life of the display element. The reflective face is the largest item of the rotatable display assembly, contributing highly to the moment of inertia. The present invention enables the reflective face to be made of materials which have little or no structural rigidity. Such materials are typically thin and light when compared with materials which have structural rigidity, and hence their use in this invention reduces the moment of inertia of the rotatable assembly considerably in comparison with prior art display assemblies.

The present invention provides an electromagnetically operated display element including a rotatable element comprising:

a support member rotatable about an axis and provided with bearing means;

mounting means connected to the rotatable support member;

a display sheet having opposite faces of contrasting appearance, the sheet including engagement means arranged to engage with the mounting means;

the rotatable support member, the mounting means and the sheet being arranged so that the sheet is permanently maintained in a substantially planar state.

According to another aspect this invention provides an electromagnetically-operated display element including a rotatable assembly comprising:

a support member rotatable about an axis, the support member including bearing means and having a permanent magnet attached to it; retaining means close to the axis connected with said support member;

arms connected with the support member;

a display sheet having opposite faces of contrasting appearance, the sheet including first engagement means arranged to engage with the retaining means and second engagement means remote from said axis arranged to engage with the arms the support member said arms and said sheet being arranged so that the sheet is permanently maintained in a desired state with regard to the support member.

Preferably, in either of the above arrangements the sheet is thin and so has little or no structural rigidity and the mounting means applies a tensioning force to the sheet whereby to maintain it in a substantially planar form.

The invention will be better understood by reference to the attached drawings.

DETAILED DESCRIPTION OF THE PREFERRED EMBODIMENTS

Figure 1:
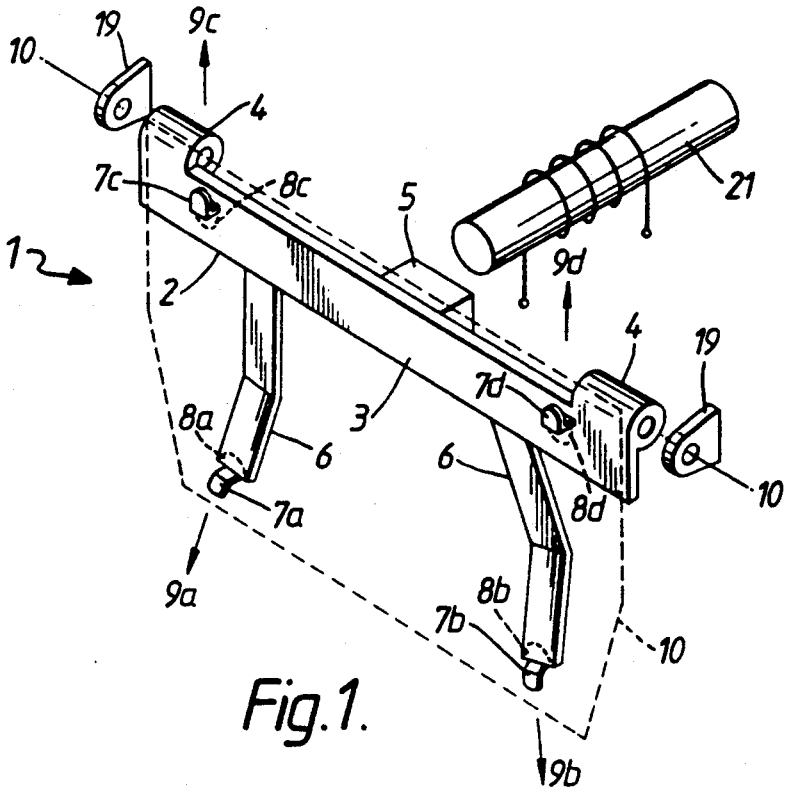
FIG. 1 illustrates a first embodiment of the invention.
Figure 2:
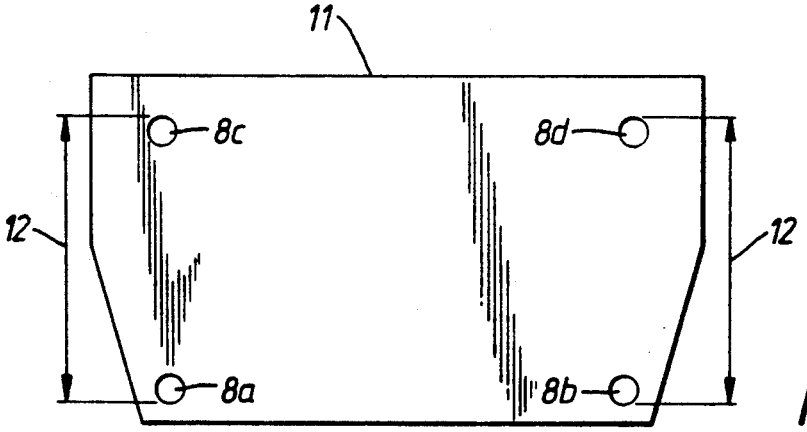
FIG. 2 illustrates the reflective face of the embodiment of FIG. 1.
Figure 3:
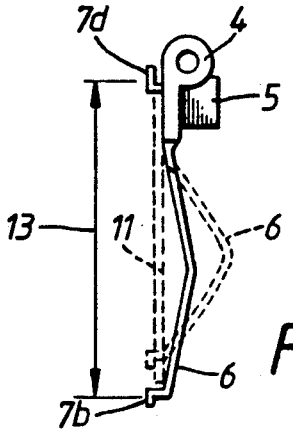
FIG. 3 illustrates a side view of the embodiment in FIG. 1.

FIGS. 1, 2 and 3 illustrate an embodiment of the invention with relation to a display member of the type described in U.S. Pat. No. 4,163,332 wherein the rotatable member is hinged about an axis close to an outer edge thereof.

In this arrangement rotatable member 1 is arranged to rotate about axis 10-10 and comprises a carrier 2 which includes a rigid support member 3 having bearing elements 4. A hinge rod, not shown, is threaded through holes in fixed brackets 19 and bearings 4. Carrier 2 also includes two spring arms 6 extending out of support 3. Support 3, bearings 4 and spring arms 6 are preferably made as one piece, for example as in injection moulding. A permanent magnet 5, driven by electromagnet 21 and having a magnetic axis parallel to that of electromagnet 21, is attached to support 3.

Spring arms 6 terminate in bent tabs or hooks *7a* and *7b*, respectively. Connected with support 3 are two further hooks *7c* and *7d*.

Hooked onto carrier 2 is a thin plastic sheet 1, shown in dotted outline in FIG. 1 in front of carrier 2. FIG. 2 shows sheet 11 prior to its attachment to carrier 2. Carrier 2 is preferably coloured black as is the back of sheet 11 next to it. The front of sheet 11 is typically coloured brightly, for example, white or fluorescent yellow. Sheet 11 is hooked onto carrier 2 by way of four holes *8a*, *8b*, *8c*, *8d* into which are hooked hooks *7a*, *7b*, *7c*, *7d* respectively. FIG. 3 shows in solid lines an arm 6 before sheet 11 is fitted and in dotted lines arm 6 after sheet 11 is fitted. In the latter state spring arm 6 is compressed and applies tension to sheet 11. The distance 13 between hooks *7b* and *7d* measured when sheet 11 is not fitted is arranged to be greater than the distance 12 between corresponding holes *8b* and *8d* in sheet 11.

Alternatively, instead of arms 6 being resilient, they may be rigid and in this case sheet 11 is made of thin elastic material which is able to be stretched for attachment to hooks 7.

Sheet 11 when fitted to carrier 2 is tensioned in the direction of arrows *9a*, *9b*, *9c*, *9d* and urged by this tensioning into a substantially flat state even if it is thin and floppy and has little or no structural rigidity.

If desired there can be more than two spring arms 6 and more than four hooks 7 tensioning sheet 11, through a suitable set o. holes 8 in sheet 11. Also, an additional hook 7 may be positioned midway between hooks *7c* and *7d* and hooked through a corresponding additional hole to improve the flatness of sheet 11.

A large, very thin sheet 11 may be susceptible to tear at the holes, and for such a sheet holes 8 can be reinforced, for example with metal or plastic eyelets or with concentric washers bonded onto sheet 11. Sheet 11 can advantageously be unhooked from support 2 and be replaced with a new one if it becomes dirty or faded with time.

Figure 4:
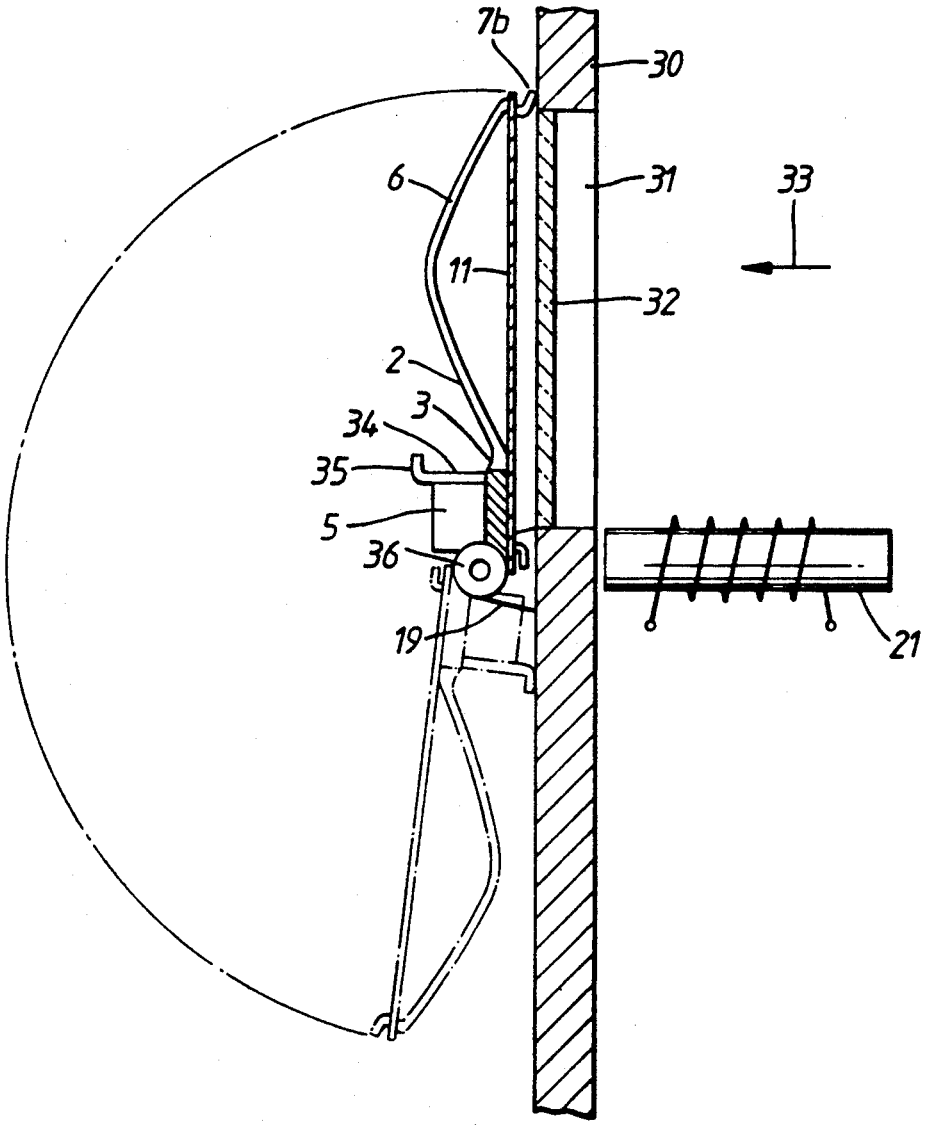
FIG. 4 illustrates the embodiment of figure mounted in a display assembly.

FIG. 4 shows a schematic side view of a display member mounted in a display assembly. The display member is a modification of that described in relation to FIGS. 1, 2 and 3. The same reference numerals identify corresponding parts and the constructional details will not be repeated. The member is mounted by means of hinge rod 36 onto panel assembly 30 which includes hinge brackets 19, an aperture 31 and a diffuser 32 through which light represented by arrow 33 can pass. Rotation of carrier 2 in the clockwise direction, to obstruct light 33, is limited by tabs *7a*, *7b* coming into contact with panel assembly 30.

Rigid member 3 is further provided with bumper element 34 such that rotation of carrier 2 in the anticlockwise direction is limited by tip 35 of bumper element 34 coming into contact with panel assembly 30. This latter position is illustrated in dotted outline in FIG. 4.

Figure 5:
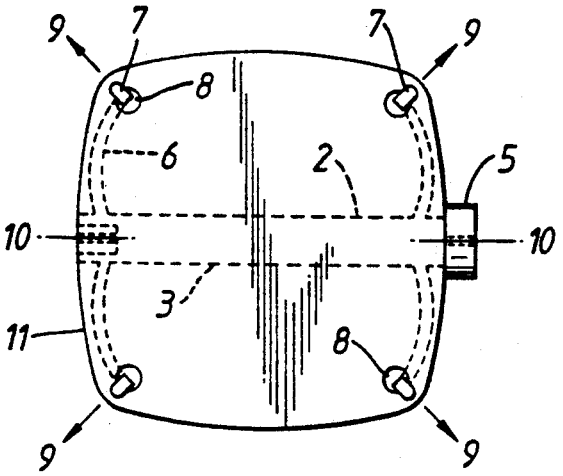
FIG. 5 illustrates a second embodiment of the invention.
Figure 6:
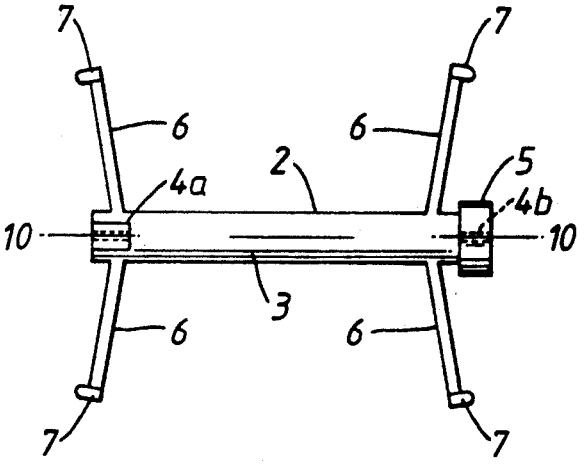
FIG. 6 illustrates the assembly shown in FIG. 5 prior to the fitting of the reflective face.
Figure 7:
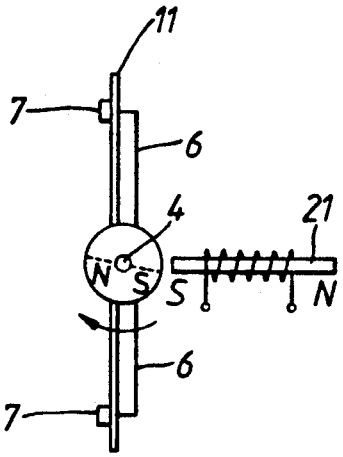
FIG. 7 illustrates a side view of the embodiment of FIG. 5.

FIGS. 5, 6 and 7 illustrate an embodiment in which the invention is applied to a rotatable magnetically-actuated reflective face display element of the type in which the face rotates about an axis close to its centre and is driven by a cylindrical magnet. This general type of display is well known from aforementioned U.S. Pat. Nos. 4,425,864; 4,015,255; 3,975,728.

As shown in FIG. 6, carrier 2 includes a rigid base 3 which includes sleeve bearings *4a*, *4b*. A cylindrical magnet 5 is fitted onto the outside of sleeve bearing *4b*. A hinge rod, not shown, is threaded through bearings *4a*, *4b*, to allow rotation around hinge axis 10—10.

Magnet 5 is driven by appropriate energization of electromagnet 21. Carrier 2 includes four spring arms 6 emanating from support member 3, each spring arm terminating in a tab or hook 7. Base 3, bearings *4a*, *4b* and arms 6 are preferably made as one piece, for example by injection moulding. Spring arms 6 are arranged to be flexed to engage their hooks 7 into corresponding holes 8 in a thin plastic display sheet 11. Because spring arms 6 are flexed prior to the attachment of sheet 11 and are under compression after the attachment, sheet 11 is permanently tensioned in directions 9 and permanently secured to support 3.

FIG. 5 shows carrier 2, which is situated behind sheet 11, in dotted outline. The face of sheet 11 visible in FIG. 5 is typically arranged to be highly reflective and the opposite face and carrier 2 are coloured black.

Sheet 11 can be very large, for example a foot high, and very thin, for example as thin as a sheet of typewriter paper. In this case holes 8 can be reinforced, for example with eyelets or washers to protect them against possible damage.

Sheet 11 may be unhooked from arms 6 and replaced with a new sheet as and when this is desirable.

Each of the above embodiments described provides a monolithic carrier structure that serves not only to tension sheet 11 but also to maintain sheet 11 in the correct position relative to support 3 and its bearings.

I claim:

1. An electromagnetically-operated display element including a rotatable assembly comprising:

a support member rotatable about an axis and provided with bearing means;

mounting means connected to said rotatable support member;

a sheet whose rotational position determines the optical state of the display element, said sheet including engagement means arranged to engage with said mounting means;

said rotatable support member, said mounting means and said engagement means being arranged so that said sheet is permanently maintained in a tensioned state in directions outwardly from a central area thereof towards peripheral portions thereof by said mounting means.

2. A display element according to claim 1 wherein said support member, said bearing means and said mounting means are made as one (monolithic) part.

3. A display element according to claim 1 wherein said sheet has opposite faces of contrasting appearance.

4. A display element according to claim 3 wherein substantially the whole of said sheet is tensioned.

5. A display element according to claim 3 wherein said sheet is tensioned both in a direction parallel to said axis and in a direction normal to said axis.

6. A display element according to claim 1 wherein said sheet includes four corners and four holes by which said sheet is connected to said support member, each said hole being adjacent to a said corner.

7. A display element according to claim 1 wherein said engagement means comprises a number of holes in said sheet each reinforced by means stronger than said sheet.

8. A display element according to claim 1 wherein said sheet is replaceable.

9. A display element according to claim 1 wherein said axis is close to an edge of said sheet.

10. A display element according to claim 1 wherein said axis is close to the centre of said sheet.

11. A display element according to claim 1 wherein the mounting means includes bowed arms arranged to act as springs.

12. A display element according to claim 11 wherein said sheet is of material so thin as to be floppy.

13. A display element according to claim 11 wherein said assembly is mounted on a panel assembly and its rotation in one direction is limited by a portion of a said arm bearing against said panel assembly.

14. A display element according to claim 11 that is back illuminated.

15. A rotatable assembly for an electromagnetically-operated display element, which comprises:

a carrier which includes a support member having bearing means that defines an axis around which the carrier can rotate, first mounting means on said support member, two arms connected to said support member and extending away therefrom, and second mounting means on said two arms, and a thin display sheet which includes engagement means for connection to said first and second mounting means in order to mount said thin display sheet on said carrier in an outwardly tensioned, substantially planar state so that the sheet is tensioned in directions outwardly from a central area thereof towards peripheral portions thereof.

16. A rotata' e assembly for an electromagnetically-operated display element, which comprises a carrier which includes a support member having bearing means that defines an axis around which the carrier can rotate, a plurality of arms connected to said support member and extending away therefrom in two substantially opposite direction, and mounting means on said arms, and a thin display sheet which includes engagement means for connection to said mounting means in order to mount said thin display sheet on said carrier in an outwardly tensioned, substantially planar state so that the sheet is tensioned in directions outwardly from a central area thereof towards peripheral portions thereof.

* * * * *